US010492616B2

(12) United States Patent
Warner

(10) Patent No.: US 10,492,616 B2
(45) Date of Patent: Dec. 3, 2019

(54) FURNITURE WITH A HEATED SEAT

(71) Applicant: DODEKA MANUFACTURING LIMITED, Victoria (CA)

(72) Inventor: Mark E. Warner, Victoria (CA)

(73) Assignee: DODEKA MANUFACTURING LIMITED, Victoria (CA)

( * ) Notice: Subject to any disclaimer, the term of this patent is extended or adjusted under 35 U.S.C. 154(b) by 0 days.

(21) Appl. No.: 15/923,520

(22) Filed: Mar. 16, 2018

(65) Prior Publication Data

US 2018/0325265 A1 Nov. 15, 2018

(30) Foreign Application Priority Data

May 10, 2017 (JP) ..... 2966277

(51) Int. Cl.

| | |
|---|---|
| ***A47C 7/74*** | (2006.01) |
| ***A47C 7/02*** | (2006.01) |
| ***A47C 7/18*** | (2006.01) |
| ***A47C 11/00*** | (2006.01) |

(52) U.S. Cl.

CPC ..... *A47C 7/748* (2013.01); *A47C 7/021* (2013.01); *A47C 7/18* (2013.01); *A47C 11/00* (2013.01); *H05B 2203/029* (2013.01)

(58) Field of Classification Search

CPC ..... A47C 7/748; A47C 21/048; A47C 7/021; A47C 7/18; H05B 2203/029

See application file for complete search history.

(56) References Cited

U.S. PATENT DOCUMENTS

| | | | | |
|---|---|---|---|---|
| 7,003,832 | B2 * | 2/2006 | Wilson | A47C 21/048 219/217 |
| 7,438,356 | B2 * | 10/2008 | Howman | A47C 7/021 297/17 |
| 7,866,743 | B1 | 1/2011 | Russell et al. | |
| 9,155,398 | B2 | 10/2015 | Arens et al. | |
| 2004/0195227 | A1 * | 10/2004 | Park | H05B 3/34 219/217 |
| 2017/0105540 | A1 * | 4/2017 | Jacobs | A47C 1/029 |

OTHER PUBLICATIONS https://galanterandjones.com/products/copy-of-helios-metreo, Helios Heated Outdoor Furniture by Galanter & Jones garden concrete bench, As early as Apr. 1, 2018, pp. 1-4.

* cited by examiner

*Primary Examiner* — Philip F Gabler
(74) *Attorney, Agent, or Firm* — Davis & Bujold PLLC; Michael J. Bujold

(57) ABSTRACT

Furniture with a heated seat consists of a fixed furniture frame having a seating surface to accommodate one or more cushions. One or more removable cushions are positioned on the seating surface. Each removable cushion includes a foam body. An electric heating pad is supported by the foam body. A cushion cover is provided that overlies the foam body. An umbilical power cord is electrically coupled to the heating pad. The umbilical power cord extends from the foam body through an opening in the cushion cover and connects with an electrical connector of a power transformer module on the furniture frame. Power is supplied by the power transformer module to the heating pad when the activation switch of the power transformer module is in the "on" position.

6 Claims, 5 Drawing Sheets

FURNITURE WITH A HEATED SEAT

FIELD

There is described furniture with a heated seat that was developed for outdoor furniture, but which has broader potential applications.

BACKGROUND

U.S. Pat. No. 7,866,743 (Russell et al) titled "Temperature Adjustable Chair" discloses a chair with a thermoelectric cooler that can selectively generate or remove heat.

U.S. Pat. No. 9,155,398 (Arens et al) titled "Heated and Cooled Chair Apparatus" discloses a chair that can be heated and cooled, with an occupancy sensor that switches off the heating or cooling apparatus when the chair is unoccupied.

SUMMARY

There is provided furniture with a heated seat. It is envisaged, that this furniture with a heated seat may be used in a number of different configurations, such as in the form of a chair, a settee, a sofa, or a love seat to name just a few. The furniture with a heated seat consists of a fixed furniture frame having a seating surface to accommodate one or more cushions. A power transformer module is mounted to the furniture frame. The power transformer module has a power cord which plugs into a power outlet. The power transformer module transforms power input received from the power outlet into a lesser voltage, which is output through at least one electrical connector at the lesser voltage. The power transformer module has an activation switch with an "on" position and an "off" position. At least one removable cushion is positioned on the seating surface. Each removable cushion includes a foam body. At least one electric heating pad is supported by the foam body. A cushion cover is provided that overlies the foam body. An umbilical power cord is electrically coupled to the at least one heating pad. The umbilical power cord extends from the foam body through an opening in the cushion cover and connectors with the electrical connector of the power transformer module on the furniture frame. Power is supplied by the power transformer module to the at least one heating pad when the activation switch of the power transformer module is in the "on" position.

With smaller foldable frame outdoor furniture, such as was disclosed in the Russell et al patent reference, the chair can be folded and removed to a storage area. With fixed frame outdoor furniture, this is usually not practical. However, upholstered surfaces of fixed frame outdoor furniture can sustain damage when left outdoors. There are many sources of environmental damages ranging from fading of fabrics due to sun, mildew from rain, soiling from blowing dust, excrement from flying birds and chewing or scratching from rodents or other passing animals. As describe above, the solution proposed involves placing heating pads into removable cushions. It is envisaged that the power transformer modules will receive a power input voltage of 110 volts and provide a lesser power output voltage of 12 volts to the heating pads.

There may be times when the owner of the furniture with a seat forgets to take in the removable cushions. Even when care is taken, cushion covers can become soiled or show wear over time. For this reason, even more beneficial results may be obtained when the cushion cover is a close fitting fabric case that slides over the foam body. The fabric case illustrated has an opening that is closed by a zipper fastener. The fabric case is, therefore, removable for cleaning or replacement by using the zipper to open the opening and withdrawing the foam body from the fabric case.

There may be times when the owner of the furniture with a seat is unexpectedly called away and forgets to turn the activation switch of the power transformer module to the "off" position. For this reason, even more beneficial results may be obtained when the activation switch is a pressure activated occupancy sensor which is in the "on" position when pressure on the foam body exceeds a pre-set threshold Buildings generally have relatively few power outlets outdoors, in many cases there is only one. This presents a problem when one wishes to have a grouping of several pieces of furniture with heated seats. This also presents a problem when one wishes to have a lamp to read by or has other power requirements in order to participate in an activity while seated on the furniture with a heated seat. For this reason, even more beneficial results may be obtained when the power transformer module is in a housing that is mounted on the furniture frame and the housing also contains a power bar module that receives power input voltage of 110 volts and provides a power output voltage that is also 110 volts.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A piece of furniture with a heated seat will now be described with reference to FIG. 1 through FIG. 9.

Figure 1:
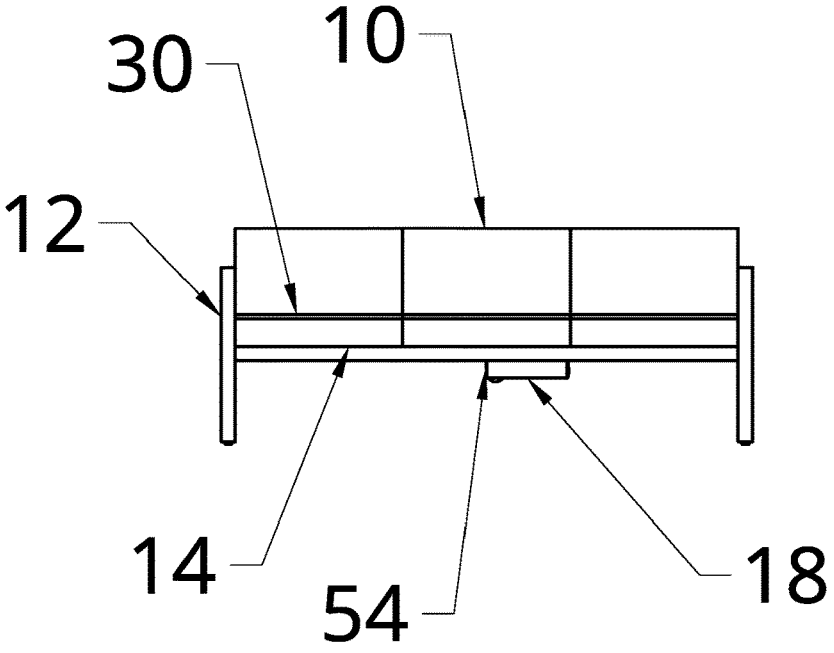
FIG. 1 is a front elevation view of a bench with removable heated cushions.
Figure 2:
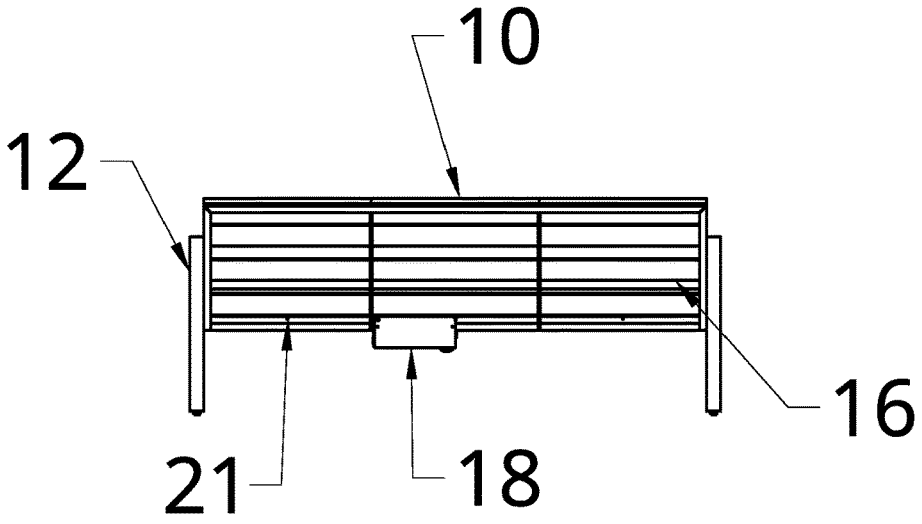
FIG. 2 is a rear elevation view of the bench of FIG. 1, with the heated cushions removed.
Figure 3:
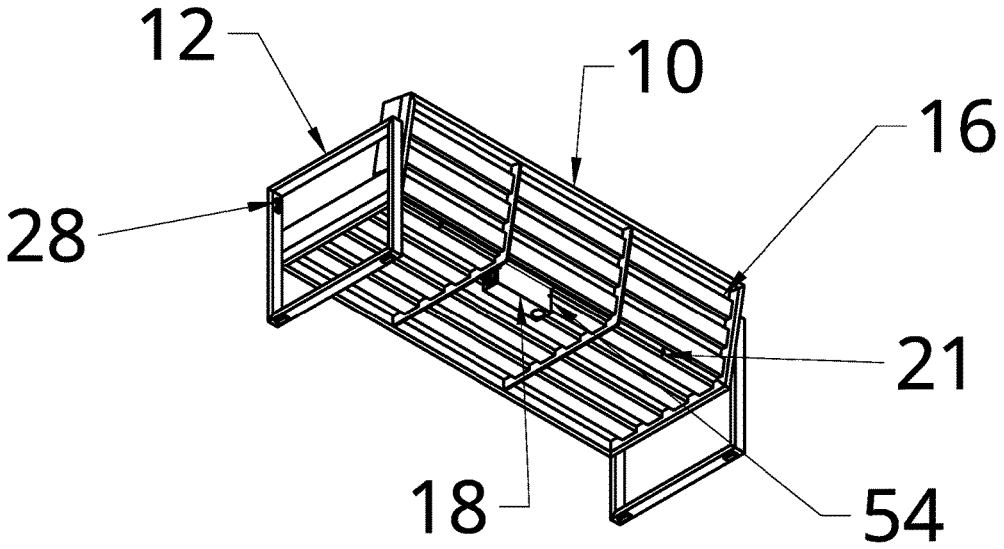
FIG. 3 is an isometric rear view of the bench of FIG. 2.

Structure and Relationship of Parts:

Referring to FIG. 1, there is illustrated a piece of furniture with a heated seat. The furniture selected for the purpose of illustrated in a sofa 10 having a fixed furniture frame 12 and a seating surface 14 large enough to accommodate three cushions 30. Furniture frame 12 is described as being "fixed" as it is not foldable. Referring to FIG. 2 and FIG. 3, furniture frame 12 is made from a number of horizontal slats 16 with spaces between each of slats 16.

Figure 4:
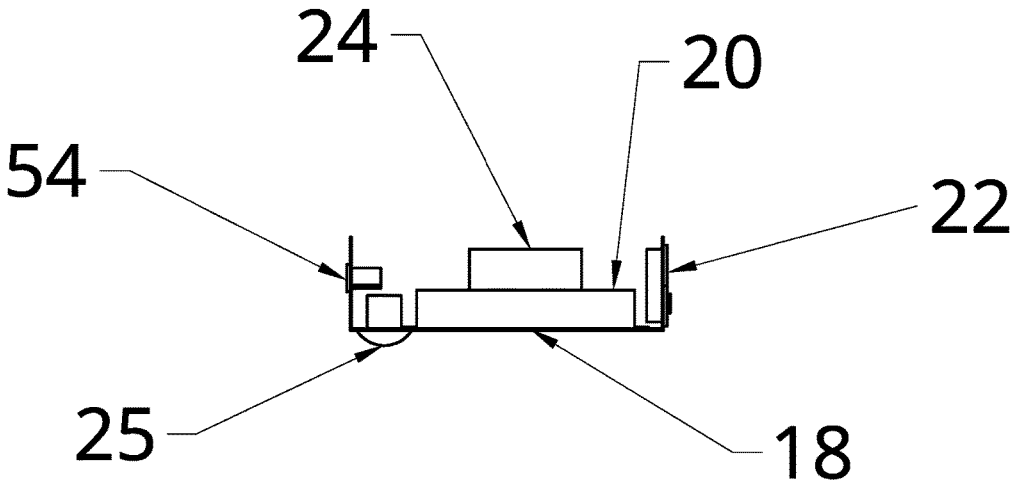
FIG. 4 is a detailed front elevation view, in section, of a control box housing shown in FIG. 3.

Referring to FIG. 2 and FIG. 3, a control box housing 18 is mounted underlying furniture frame 12. Referring to FIG. 4, included in housing 18 is a power transformer module 20.

Figure 9:
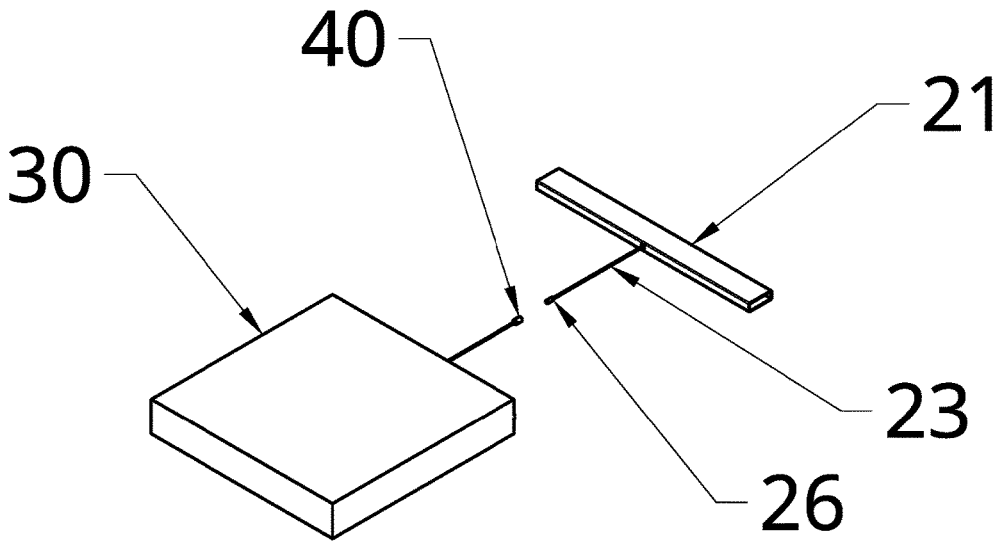
FIG. 9 is an isometric bottom view of showing connection detail with a connection manifold on the bench with removable heated cushions of FIG. 1.

Referring to FIG. 4, power transformer module 20 has a power cord 22 which plugs into a standard 110 volt power outlet (not shown), a power transformer module 20 transforms the 110 volt power input received from the 110 volt power outlet into a lesser voltage, preferably 12 volt direct current. Referring to FIG. 9, power transformer module 20 has a connection manifold 21 providing more than one electrical connector 26. Referring to FIG. 1 and FIG. 2, connection manifold 21 extends lengthwise along seating surface 14. Referring to FIG. 9, one of the electrical connectors 26 is provided for each cushion 30. In other words, there is a one to one relationship between electrical connectors 26 and cushions 30. Each electrical connector 26 provides 12 volt direct current power output. Optionally, each of electrical connectors 26 may be positioned at an end of an anchor cord 23 that extends from connection manifold 21. Referring to FIG. 3, a manual activation switch 28 is provided on fixed furniture frame 12 that enables power transformer module 20 to be switched between an "on" position and an "off" position. Referring to FIG. 4, a power control module 24, associated with power transformer module 20, delivers power to electrical connectors 26 according to the position of manual activation switch 28.

Figure 5:
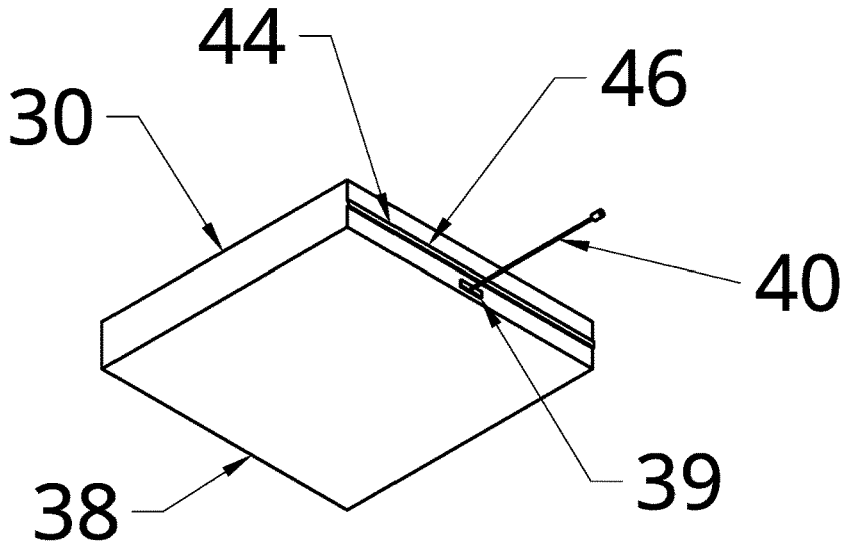
FIG. 5 is an isometric bottom view of one of the heated cushions from FIG. 1.
Figure 6:
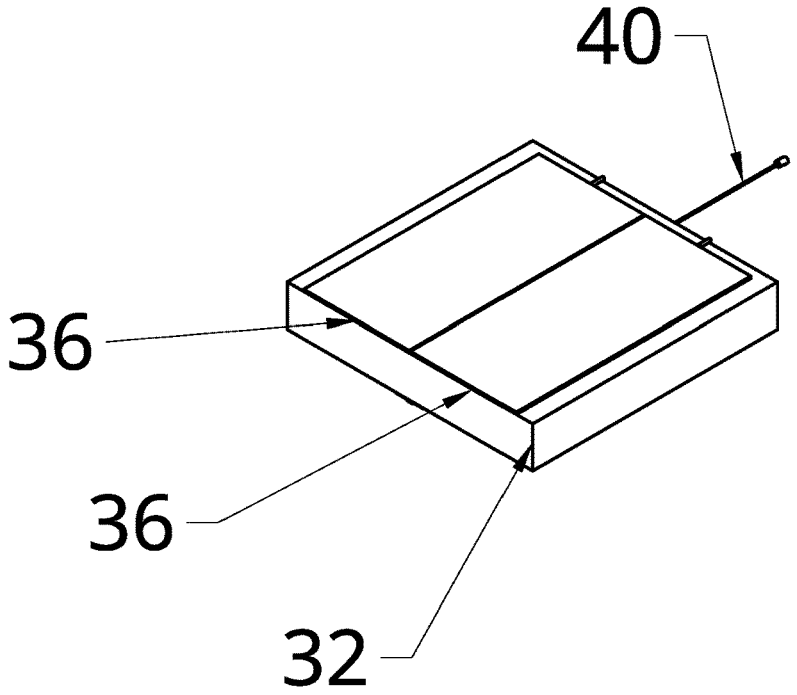
FIG. 6 is an isometric front view of one of the heated cushions from FIG. 1, with cushion cover removed.
Figure 7:
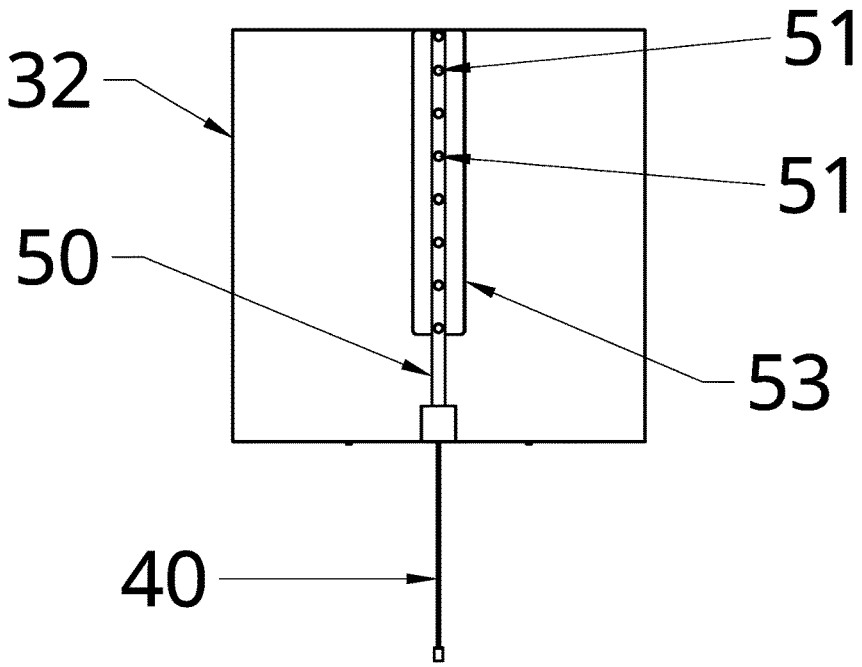
FIG. 7 is a bottom plan view of the heated cushion of FIG. 6.
Figure 8:
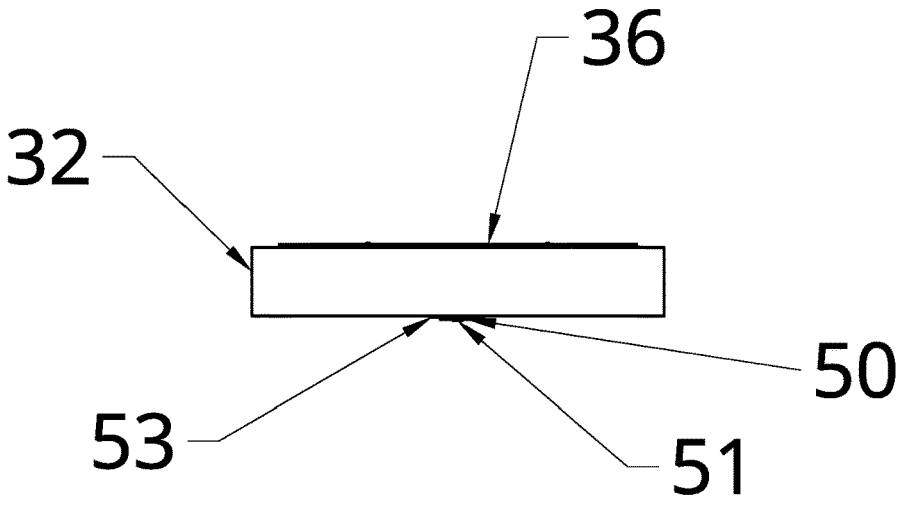
FIG. 8 is a front elevation view, in section, taken along section lines 8-8 of FIG. 6.

Referring to FIG. 1, three removable cushions 30 are positioned on seating surface 14. Referring to FIG. 6 through 8, each removable cushion 30 includes a foam body 32. At least one electric heating pad 36 is supported by foam body 32. In the illustrated embodiment of removable cushion 30, two electric heating pads 36 are supported by foam body 32. Referring to FIG. 5, each removable cushion 30 has a fabric cushion cover 38 that overlies foam body 32. It is preferred that cushion cover 38 be made from a water proof or water resistant material to provide some protection from exposure to rain. It is not essential that cushion cover 38 be waterproof, as heating pads 36 and all other electrical components are water proof and rated for use in outdoor environments. Referring to FIG. 6 and FIG. 8, an umbilical power cord 40 is electrically coupled to the two heating pads 36. Umbilical power cord 40 extends from foam body 32. Referring to FIG. 5, when foam body 32 is covered by cushion cover 38, umbilical power cord 40 extends through an opening 39 in each cushion cover 38. Referring to FIG. 9, umbilical power cord 40 connects with one of electrical connectors 26 of power transformer module 20 positioned along connection manifold 21 that extends lengthwise along seating surface 14 of furniture frame 12. Power is supplied by power transformer module 20 to each heating pad 36 when activation switch 28 of power transformer module 20 is in the "on" position. Referring to FIG. 4, a light emitting diode 25 on control box 18 illuminates when power is being supplied.

Referring to FIG. 5, there is illustrated in more detail cushion cover 38. Cushion cover 38 is a close fitting fabric case that slides over foam body 32. Cushion cover 38 has an opening 44 that is closed by a zipper fastener 46. Cushion cover 18 is removable for cleaning or replacement by moving zipper fastener 46 to open opening 44 and withdrawing foam body 32 from cushion cover 38.

Referring to FIG. 7 and FIG. 8, in addition to manual activation switch 28 or instead of manual activation switch 28, the activation switch can be in the form of a pressure activated occupancy sensor 50 mounted to an underside of foam body 32. Occupancy sensor 50 is in the "on" position when pressure on foam body 32 exceeds a pre-set threshold. In order to improve the sensitivity of occupancy sensor 50, there is provided a series of pressure amplifiers 51 mounted to an elongated ultra-high weight molecular (UHMW) pad 53.

It is preferred that control box housing 18 also contain a power bar module 52 that receives power input voltage of 110 volts and has a plug-in receptacle 54 that provides a power output voltage that is also 110 volts. The purpose of power bar module 52 is to allow other pieces of heated furniture, lamps or other accessories to be plugged in during use of sofa 10.

Operation:

Referring to FIG. 2, fixed furniture frame 12 is placed outdoors on a patio or deck. 110 volt power is supplied from a municipal power supply to control box 18 in which is positioned power transformer module 20. Due to the size and weight of fixed furniture frame 12, it is rarely moved. Referring to FIG. 5, removable cushions 30 are normally stored inside, where they will be protected from weather, animal or other damage. Referring to FIG. 9, as cushions 30 are placed on seating surface 14 of fixed furniture frame 12, they are electrically connected by connecting umbilical power cord 40 to one of electrical connectors 26 at the end of one of anchor cords 23 extending from connection manifold 21. Referring to FIG. 3, power can be supplied by turning manual activation switch 28 on fixed furniture frame 12 to the "on" position. Referring to FIG. 7 and FIG. 8, alternatively, power occupancy sensor 50 can be used as an activation switch with the "on" position being when pressure on foam body 32 exceeds a pre-set threshold. Referring to FIG. 4, power transformer module 20 converts the 110 volt input power to 12 volt output power. Referring to FIG. 6 and FIG. 8, the 12 volt output power is used to power heating pads 36, thereby heating cushions 30. Where there are further power requirements, 110 volt power can be provided through plug-in receptacle 54 of power bar module 52.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A furniture sofa with a heated seat, comprising:

a fixed furniture frame having a number of horizontal slats with spaces between each of slats that define a seating surface to accommodate two or more seat cushions;

a power transformer module mounted to the furniture frame, the power transformer module having a power cord which plugs into a power outlet, the power transformer module receives power input from the power outlet and transforms the power into a lesser voltage which is output through two or more electrical connectors at the lesser voltage, the power transformer module having a connection manifold extending lengthwise along the seating surface with the two or more electrical connectors spaced along the connection manifold, the power transformer module having an activation switch with an "on" position and an "off" position;

two or more removable seat cushions positioned in side by side relation on the seating surface, each removable seat cushion comprising:

a foam body;

at least one electric heating pad supported by the foam body;

a cushion cover that overlies the foam body; and an umbilical power cord electrically coupled to the at least one heating pad, the umbilical power cord extending from the foam body through an opening in the cushion cover and connecting with one of the two or more electrical connector of the power transformer module on the furniture frame, whereby power is supplied by the power transformer module to the at least one heating pad when the activation switch of the power transformer module is in the on position.

2. The furniture sofa with a heated seat of claim 1, wherein the cushion cover is a close fitting fabric case that slides over the foam body, the fabric case having an opening that is closed by a zipper fastener, the fabric case being removable for cleaning or replacement by activating the zipper to open the opening and withdrawing the foam body from the fabric case.

3. The furniture sofa with a heated seat of claim 1, wherein the activation switch is a pressure activated occupancy sensor which is in the "on" position when pressure on the foam body exceeds a pre-set threshold.

4. The furniture sofa with a heated seat of claim 1, wherein the power input voltage is 110 volts and the lesser power output voltage is 12 volts.

5. The furniture sofa with a heated seat of claim 1, wherein the power transformer module is received in a housing that is mounted on the furniture frame, the housing also containing a power bar module that receives power input voltage of 110 volts and provides a power output voltage that is also 110 volts.

6. The furniture sofa with a heated seat of claim 1, wherein each of the electrical connectors is positioned at an end of an anchor cord that extends from the connection manifold.

* * * * *